United States Patent [19]

Tucker et al.

[11] Patent Number: 4,932,471

[45] Date of Patent: Jun. 12, 1990

[54] DOWNHOLE TOOL, INCLUDING SHOCK ABSORBER

[75] Inventors: James C. Tucker, Graham; Stephen E. Tilghman, Duncan, both of Okla.

[73] Assignee: Hilliburton Company, Duncan, Okla.

[21] Appl. No.: 397,080

[22] Filed: Aug. 22, 1989

[51] Int. Cl.[5] ..... E21B 17/07; E21B 23/10; E21B 47/06

[52] U.S. Cl. ..... 166/64; 166/65.1; 166/113; 175/40; 267/125

[58] Field of Search ..... 166/64, 65.1, 250, 177, 166/178, 241, 113; 175/40, 45, 50, 321; 188/311, 312, 322.22, 322.19; 267/71, 125, 140.1, 141, 153; 73/11, 151

[56] References Cited

U.S. PATENT DOCUMENTS

| | | | |
|---|---|---|---|
| 2,176,766 | 10/1939 | Johnston | 166/178 |
| 2,576,924 | 12/1951 | Coberly | 188/311 X |
| 2,577,599 | 12/1951 | Bethancourt | 73/151 |
| 3,381,780 | 5/1968 | Stachowiak | 267/125 X |
| 4,149,593 | 4/1979 | Gazada et al. | 166/64 X |
| 4,223,746 | 9/1980 | Tanguy et al. | 267/125 X |
| 4,585,099 | 4/1986 | Taylor | 188/322.19 |
| 4,665,398 | 5/1987 | Lynch et al. | 340/853 |
| 4,679,669 | 7/1987 | Kalb et al. | 73/151 X |
| 4,693,317 | 9/1987 | Edwards et al. | 166/378 |

OTHER PUBLICATIONS

A TOTCO Brochure entitled "Drift Indicators" believed to be more than one year prior to Aug., 1989, (note 1984 copyright notice).

*Primary Examiner*—Stephen J. Novosad

*Attorney, Agent, or Firm*—James R. Duzan; E. Harrison Gilbert, III

[57] ABSTRACT

In a preferred embodiment, an eletronic temperature gauge is carried into a well bore within a pressure-sealed housing which can free fall through a drill string to impact upon a drill bit connected at the bottom of the drill string. A shock absorber is connected at the bottom of the housing to absorb the shock upon impact of the apparatus on the drill bit. The shock absorber has a relatively linearized shock absorbing response in the preferred embodiment. Additional structural features provide further cushioning of the gauge during transit and upon impact.

19 Claims, 3 Drawing Sheets

DOWNHOLE TOOL, INCLUDING SHOCK ABSORBER

BACKGROUND OF THE INVENTION

This invention relates generally to a downhole tool including a shock absorber and to the shock absorber itself. The invention relates more particularly, but not by way of limitation, to a downhole tool which carries an object into a well so that the shock absorber cushions it upon impact within the well. The present invention also more particularly, but without limitation, relates to such a downhole tool, also including an electronic temperature gauge, which can be dropped down a drill string to a drill bit connected at the bottom of the drill string.

From time to time in drilling, completing or producing an oil or gas well, implements need to be put into the well. These can be mechanically conveyed into the well such as on a wire line or a tubing string, or they can be dropped into the well. As used herein, something is "dropped" into the well when it is not connected to any other structure and is placed in the well to free fall or be pumped by fluid.

When an implement is conveyed or dropped into the well, sometimes it needs to be cushioned against shocks which might be transmitted to or through it upon the implement impacting the bottom of the hole or some other stop located within the well. To provide this cushioning, various types of shock absorbers have been proposed or used.

To give a specific example, reference will be made to a device for measuring temperature in a well. Measuring temperature in a well is important because, for example, a knowledge of the temperature at which cement will be pumped and a knowledge of the temperature at which the cement will cure are needed for designing and performing a desired job of cementing pipe into the well bore. These measurements are needed to improve the formulation of a particular cement composition to be used in a particular well, which formulation should allow adequate pumping time and desired set up time after pumping.

One type of device which has been put in a well to measure temperature comprises steel balls in which thermal paper is placed. The balls are dropped and circulated down the well bore and back to the top. During such a trip, the thermal paper records the maximum temperature. This device does not record other temperatures or indicate where the maximum temperature occurred.

Electronic temperature probes have also been used. These have been carried in on bundle carriers connected within a pipe string. This technique requires that taking of temperature measurements be planned with pipe string trips into and out of the well.

Temperature probes have also been run into wells on wire lines. Wire lines, however, are typically difficult to get into the well bore at the same time as mud is to be circulated, such as may need to occur during drilling. Additionally, running a wire line after circulation stops will likely not yield an accurate temperature value which would occur during actual circulation.

Static temperature buildup or different circulating temperature profiles cannot be measured except with the aforementioned bundle-carried temperature probe, but, again, that option has the expensive and time-consuming shortcomings of requiring the use of tubing string and coordinating with a trip of such string into and out of the well.

Therefore, there is the specific need for an apparatus which can obtain an accurate temperature at total depth without the use of a tubing string or wire line and there attendant shortcomings. Thus, such an apparatus is preferably of the type which includes a temperature probe that can take the desired readings and also of the type which can be dropped into the well. Because of the relatively delicate nature of the electronics in a suitable temperature probe, there is the further need for the apparatus to include a suitable shock absorber which will cushion the impact of the temperature probe upon impact at total depth. More generally, there is the need for an improved shock absorber for use in a well, which shock absorber can be part of an apparatus for carrying an object into a well.

SUMMARY OF THE INVENTION

The present invention overcomes the above-noted and other shortcomings of the prior art by providing a novel and improved downhole tool including a shock absorber and a shock absorber itself. In a particular aspect the present invention can be used in the delivery of an electronic gauge to total depth to make various measurements, such as of temperature.

The present invention has the advantage that it can be transported to the bottom of a well by being dropped into a drill string, for example, and pumped or allowed to free fall to the bottom of the string or well. The invention withstands the shock and vibration of the fall as well as the impact on the drill bit or other stopping structure in the well.

Since the present invention is preferably transported to the bottom by being dropped, the present invention minimizes the amount of time needed to prepare the drill string with special equipment and minimizes the need for elaborate special equipment in the drill string as would be needed if the invention were to be conveyed on the string itself or on a wire line. The present invention can, however, be adapted for use with equipment which is conveyed into the well on some structure if desired.

Accordingly, the present invention provides a particular shock absorber for an implement used in a well, comprising: a support body adapted to connect to the implement, which support body includes: a side wall defining, at least in part, a chamber within the support body; and communication means, defined through the side wall, for permitting fluid communication across and along a length of the side wall between the chamber and the exterior of the support body; and a member retained within the support body to create a shock absorbing effect by movement of the member between a position wherein the member does not block fluid flow through the communication means and a position wherein the member blocks a portion of the communication means so that the member pushes fluid from the chamber through a progressively smaller area of the communication means as the member moves within the support body. In the combination of the present invention, other types of shock absorbers, such as a dash pot can be used.

In a particular embodiment combination, the present invention provides a downhole tool which can be dropped down a drill string to a drill bit connected at the bottom of the drill string. This tool comprises: a pressure-sealed housing having a top end and a bottom end; an electronic temperature gauge carried in the pressure-sealed housing; and a shock absorber connected to the bottom end of the pressure-sealed housing, the shock absorber including: a piston having a piston head at one end and a free end at the other end; a piston housing having an upper end connected to the bottom end of the pressure-sealed housing and the piston housing having a lower end receiving the piston head end of the piston, the piston housing having defined therein: a first set of longitudinally aligned holes; and a second set of longitudinally aligned holes circumferentially spaced from the first set and wherein the holes in the second set are longitudinally offset from the holes in the first set so that each hole lies on a different respective circumferential plane of the piston housing; a retainer connected to the free end of the piston so that the retainer engages the drill bit after the tool has been dropped down the drill string; and a spring disposed about the piston between the retainer and the lower end of the piston housing, wherein the spring provides a biasing force tending to move the piston to a fully extended position at which the piston head is at the lower end of the piston housing.

From the foregoing, it is a general object of the present invention to provide a novel and improved downhole tool including a shock absorber and the shock absorber itself. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

As used herein, terms such as "top," "upper," "bottom" and "lower" relate to the top and bottom of the pages of drawings and to the normal orientation of the preferred embodiment of the present invention in a vertical well. The term "longitudinal" pertains to the lengthwise or longer dimension of the respective component.

Figure 1:
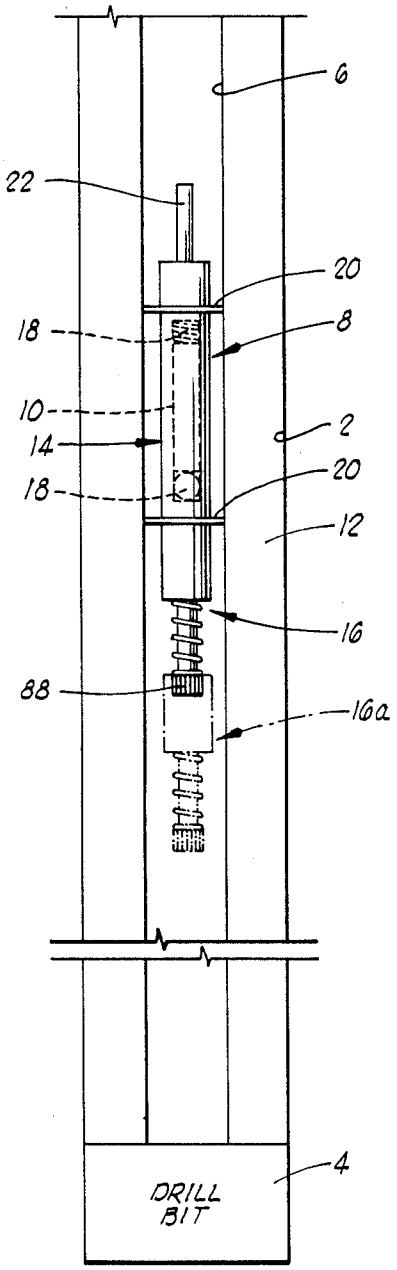
FIG. 1 is a schematic illustration of the present invention during its descent through a drill string in a well, with alternative additional structure depicted in dot-dash lines.

Referring to FIG. 1, a well bore 2 is shown being drilled by a drill bit 4 connected at the bottom of a drill string 6 which comprises a string of interconnected tubular members as known in the art. Although the drill bit 4 has ports open to permit fluid flow, the drill bit 4 otherwise mechanically closes the lower end of the string 6. That is, the string 6 may be referred to as a mechanically closed-end string. The present invention is not, however, limited to use in this type of structure.

Figure 2:
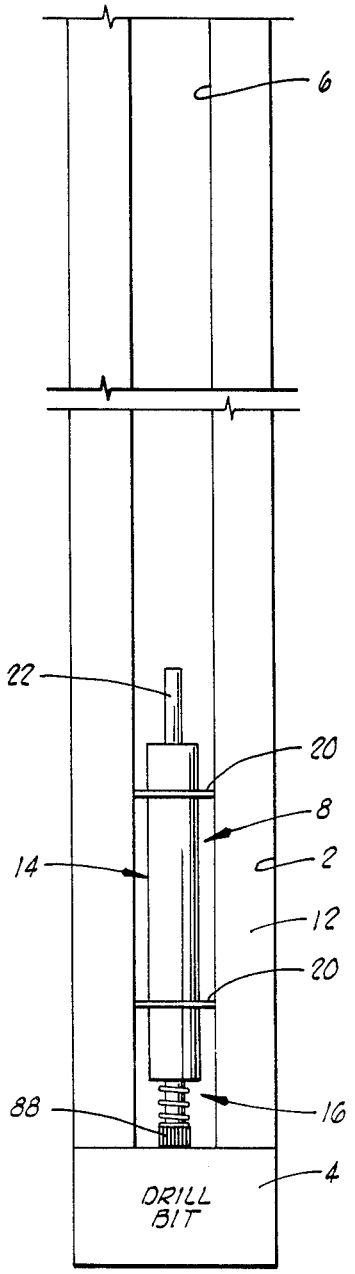
FIG. 2 is a schematic illustration showing the principal embodiment of FIG. 1 in a position where the invention has impacted a drill bit at the bottom of the drill string.

Shown in a position of descent within the drill string 6 is a schematically illustrated preferred embodiment of the present invention. The preferred embodiment is an apparatus 8 which carries and includes, in the preferred embodiment, an object 10. More specifically, the preferred embodiment of the present invention is a downhole tool which can be dropped down the drill string 6 to the drill bit 4. When it is dropped in the drill string 6, the apparatus 8 descends by free-fall and/or by being pumped with drilling mud or other substance typically circulated through the drill string 6, the drill bit 4 and an annulus 12 defined between the drill string 6 and the well bore 2. The preferred embodiment apparatus 8 will descend until it is stopped upon impact against the drill bit 4 as illustrated in FIG. 2.

Still referring to FIG. 1, the preferred embodiment of the apparatus 8 includes: the object 10; a housing 14 in which the object 10 is carried; a shock absorber 16 connected to the bottom of the housing 14 so that the shock absorber 16 absorbs shock in response to the apparatus 8 being dropped into the well and the shock absorber 16 engaging the bit 4 which acts as a stop preventing further downward movement of the dropped apparatus 8; other cushioning components 18 located within the housing 14 to further cushion the object 10; centralizers 20 for centralizing the apparatus 8 within the well, and particularly within the drill string 6, and for limiting the terminal velocity at which the apparatus 8 can fall or descend through the drill string 6 and for providing radial shock absorption; and a conventional overshot 22 connected to the top of the housing 14, which overshot 22 permits the apparatus 8 to be retrieved by suitable equipment known in the art. These components, other than the conventional overshot 22, will be more particularly described with reference to FIGS. 3A–3D.

Figure 3A:
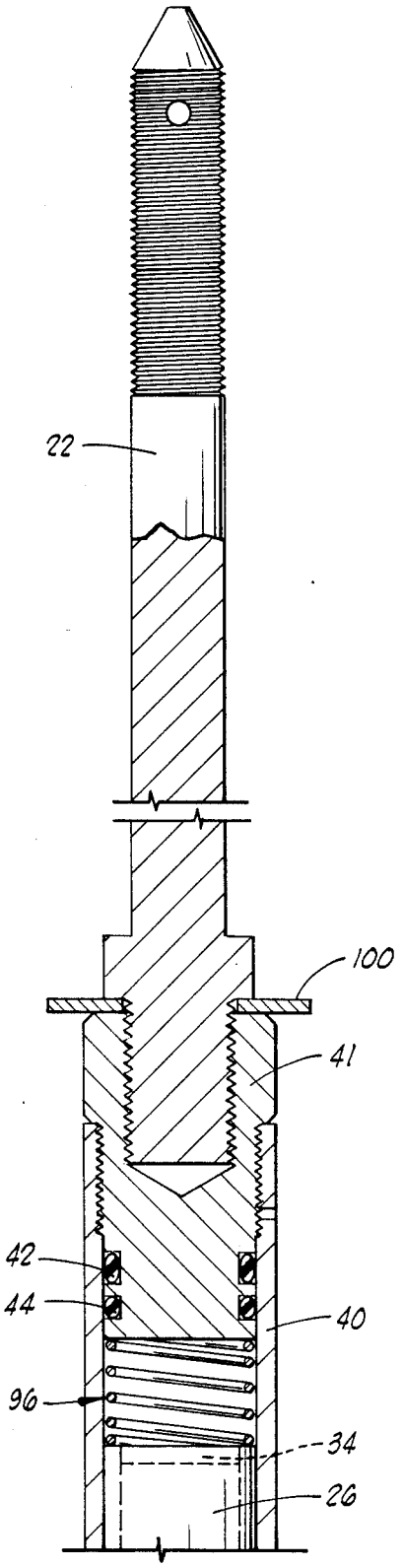
FIGS. 3A–3D comprise a sectional view of a preferred embodiment of the present invention.
Figure 3B:
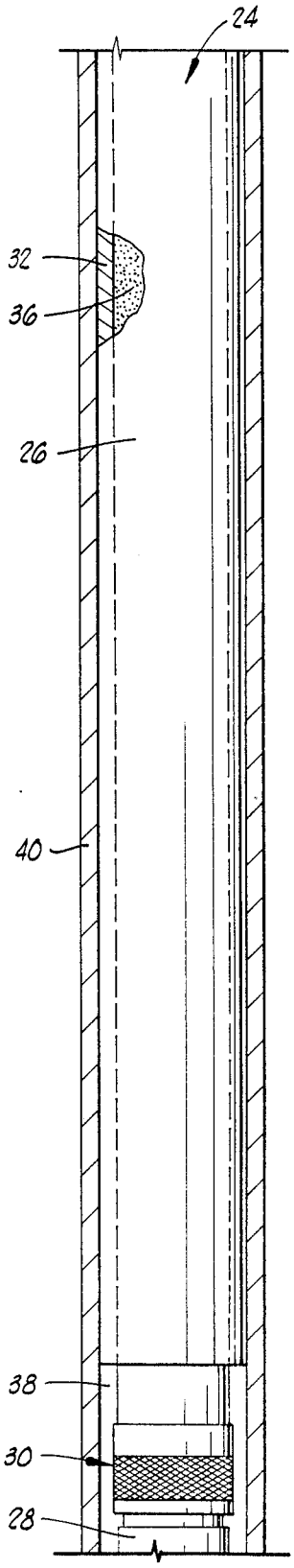
Figure 3C:
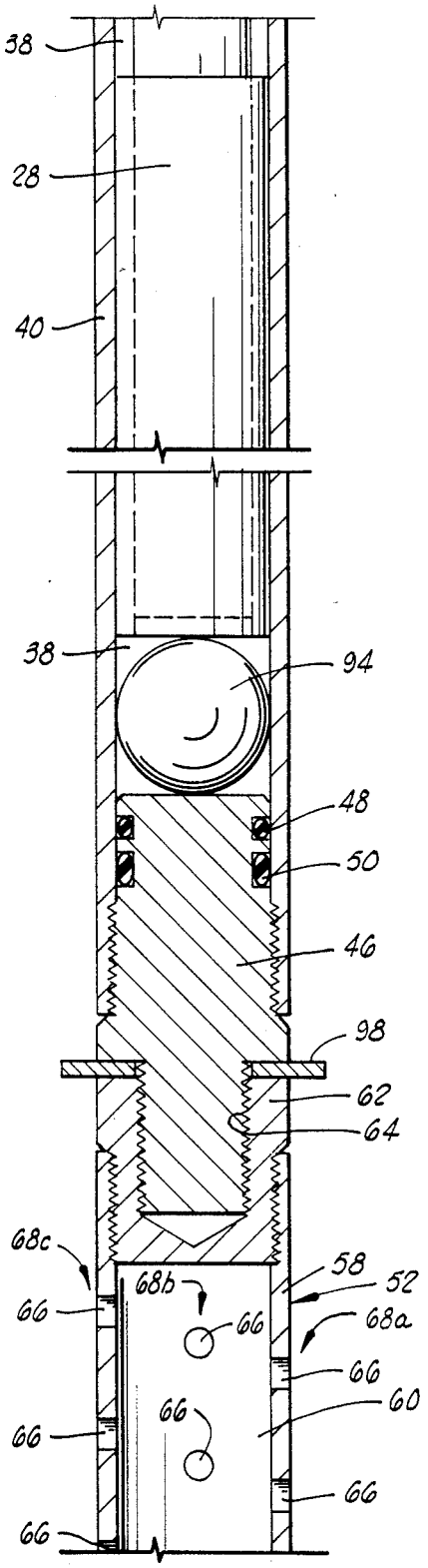

The object 10 of the preferred embodiment is an electronic temperature gauge 24. An example of a suitable such gauge is the gauge disclosed in U.S. Pat. No. 4,665,398 to Lynch et al, which gauge also measures pressure. As packaged in the preferred embodiment of the present invention, however, the gauge 24 includes an elongated potted electronics package 26 (FIGS. 3A–3B) mechanically and electrically connected to an elongated potted battery package 28 (FIGS. 3B–3C). The connections are made through mechanically coupled mating connectors 30 which are extensions from the packages 26, 28. The connectors 30 are uncovered to permit a person to make a secure, positive mechanical connection between the two packages 26, 28.

The electronics package 26 includes the electronics of the gauge 24, and the battery package 28 contains the batteries for energizing the electronics in the package 26. Both the electronics and the batteries are packaged in the same way. This packaging includes a cylindrical cardboard tube or sleeve 32 closed at one end by an end piece 34 and at the other end by the respective member of the connectors 30. A conventional silicone or other suitable type of potting material 36 is used between the inner diameter of the sleeve 32 and the respective electronics or batteries to secure the respective electronics or batteries within the respective sleeve. Preferably the potting material is of a type which can be removed to permit the electronics to be accessed if needed. Each of the sleeves 32 has an outer diameter substantially the same as the inner diameter of a chamber or cavity 38 defined within the housing 14.

The chamber 38 of the housing 14 is defined within a cylindrical tubular member 40 (FIGS. 3A–3C) having a length greater than the combined length of the connected electronics package 26 and battery package 28. The chamber 38 is pressure-sealed by a top end adapter 41 (FIG. 3A) which carries sealing rings 42, 44 and by a bottom end adapter 46 (FIG. 3C) which carries sealing rings 48, 50. The adapters 41, 46 are threaded to mating threads defined at the top and bottom ends, respectively, of the housing tube 40. When so connected, the seal rings 42, 44, 48, 50 seal against the inner surface of the tubular member 40. The top end adapter 41 receives the overshot 22, and the bottom end adapter 46 receives the shock absorber 16.

Figure 3D:
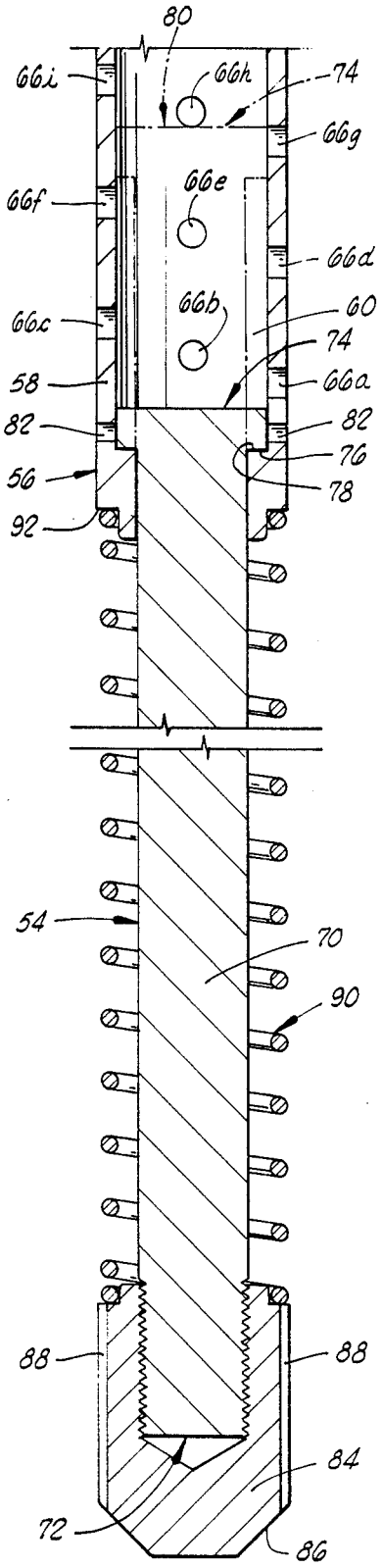

Connected to the bottom adapter 46 is the shock absorber 16. The shock absorber 16 can be any suitable type, but in the preferred embodiment the shock absorber 16 includes a support body 52 (FIGS. 3C–3D) which supports and receives an elongated member 54 (FIG. 3D). The support body 52 can be referred to as a piston housing, and the member 54 can be referred to as a piston.

The support body 52 includes a cylindrical sleeve 56 which includes a side wall 58 defining, at least in part, a chamber 60. An upper end of the sleeve 56 has connected to it by threaded engagement, an end coupling adapter 62 having a threaded bore 64 which receives a threaded extension of the end adapter 46. As will be explained further hereinbelow, the threaded bore 64 can also selectably couple with a member 54 of another shock absorber 16.

The support body 52 also includes communication means, defined through the side wall 58, for permitting fluid communication across and along a length of the side wall between the chamber 60 and the exterior of the support body 52. The communication means includes a plurality of spaced openings 66 having effective outlet areas which are progressively reduced as the member 54 retracts into the sleeve 56. The openings 66 can be slots, holes, or the like, but they are depicted as circular radial holes in the preferred embodiment of FIGS. 3A–3D. In the preferred embodiment, there are at least two openings which are longitudinally spaced from each other so that the progressive area reduction results as the member 54 moves upwardly as depicted in the drawings. As the member 54 moves upwardly as viewed in the drawings, it pushes fluid, which will be in the chamber 60 when the apparatus 8 is in a well, through at least two openings 66 ahead of it until the member 54 reaches a first one of the two, whereupon continued movement of the member 54 pushes fluid through the second one (and any others still ahead of the member 54) but not the first one (or any others which the member 54 has passed.) Thus, the effective outlet areas for this direction of movement of the member 54 are defined by any holes 66 which are above a particular position of the upper end of the member 54. A position resulting from such upward movement is depicted in FIG. 3D by the dot-dash lines. The effective outlet area for this position would include holes 66 shown in FIG. 3C and holes **66*h*, 66*i*** in FIG. 3D.

The preferred embodiment communication means specifically includes four sets of longitudinally aligned, but spaced, holes 66. Three of the sets are identified in FIGS. 3C–3D by the reference numerals **68*a*, 68*b*, 68*c*. The fourth set is in the removed section not shown in the drawings; it would lie diametrically opposite the set 68*b*. The sets 68 are circumferentially spaced from each other, and the holes 66 in each set are longitudinally offset from holes in the other sets so that each hole 66 lies on a different respective circumferential plane of the cylindrical side wall 58. As is apparent from FIGS. 3C–3D, this creates a distribution of holes wherein only a single hole at a time is closed as the member 54 progressively retracts. This tends to linearize the response of the shock absorber 16** to smooth the cushioning; however, some degree of cushioning would be provided even if the holes were aligned or overlapping or continuous slots were used. To accomodate different loading variations, the size of the holes and the length of the vertical rows can be varied.

The communication means and the side wall 58 can be internal of the shock absorber 16 so that fluid is metered internally. More generally, other types of cushioning or damping can be used.

The member, or piston, 54 includes a shaft 70 extending from a free end 72 to an enlarged, piston head, end 74 which is housed within the sleeve 56. The end 74 includes an annular surface 76 which abuts an annular shoulder 78 at the lower end of the support body 52 when the member 54 is in its fully extended position which is the primary position shown in FIG. 3D. The enlarged end 74 moves from this fully extended position where it is spaced from the lowermost hole 66 to a position of retraction, such as depicted by the reference numeral 80, wherein the enlarged end 74 blocks at least a portion of the communication means (e.g., hole **66*g*, with holes 66*a*–66*f* capable of allowing fluid into the chamber 60 behind the end 74, but not used for further cushioning fluid outlet flow for the specific upward stroke of the member 54**).

The shock absorber 16 also includes one or more radial openings 82 defined through the side wall 58 at a location where each opening 82 is adjacent the enlarged end 74 at the fully extended position of the member 54. In the preferred embodiment, this places the opening 82 adjacent the annular shoulder 78 at the lower end of the support body 52. As shown in FIG. 3D, the enlarged end 74 blocks each opening 82 when the member 54 is fully extended. The function of the opening 82 is to receive external fluid when the member 54 retracts, and to flush internal fluid when the member 54 extends. The preferred embodiment positioning of the opening 82 allows complete flushing so that full extension can be obtained.

The shock absorber 16 also includes a retainer cap 84 which is threadedly connected to the free end 72 of the member 54. The retainer 84 includes a face 86 which engages the drill bit 4 (or other structure it encounters) when the shock absorber 16 is to function (i.e., upon impact of the shock absorber 16 against the stopping structure). The retainer 84 includes one or more voids or grooves 88 which extend from the face 86 so that the face 86 cannot seal against the stop.

The shock absorber 16 also includes a spring 90 retained concentrically about the shaft 70 of the member 54 by the retainer cap 84 which is threaded onto the free end 72 of the member 54 after the spring 90 has been received on the shaft 70. The other end of the spring 90 abuts an outer annular surface 92 at the bottom end of the support body 52. The spring 90 provides a biasing force which tends to move the member 54 to its fully extended position.

The shock absorber 16 can include additional shock absorber structures connected in series to the shock absorber 16 described hereinabove. For the preferred embodiment, the retainer cap 84 is unscrewed from the free end 72 of the member 54 and a duplicate shock absorber **16*a* (FIG. 1) is connected by screwing the free end 72 from which the cap 84 has been removed into the end coupling adapter of the other shock absorber 16*a***. Additional shock absorbers ca be similarly connected.

Although the shock absorber(s) 16 is(are) the primary cushioning means in the preferred embodiment of the present invention, other shock absorbing or cushioning is provided by the components 18. These include a resilient ball 94 disposed in the pressure-sealed housing 14 between the gauge 24 and the bottom end adapter 46. The resilient ball 94 supports the gauge 24 from below, and it prevents or reduces high frequency shock transmissions which might otherwise be passed through the solid structural pieces of the apparatus 8 to the gauge 24 thereof.

Another additional cushioning component 18 is a spring 96 disposed in the pressure-sealed housing 14 between the gauge 24 and the top end adapter 40. The spring 96 supports the gauge 24 from above and it takes up any slack to obviate close manufacturing tolerances in the housing 14 and to allow the use of one housing size for different sized objects 10.

The preferred embodiment of the apparatus 8 also includes the centralizers 20. In the preferred embodiment, there is a lower centralizer 98 and an upper centralizer 100. Both of these cooperate to centralize the apparatus 8 within the drill string 6. They also cooperate to limit the velocity at which the apparatus 8 can fall through the drill string 6. They also can function as radial shock abosrbers. The centralizer 98 is retained between the threadedly coupled adapters 46 and 62. The centralizer 98 also helps maintain the shock absorber housing 52 spaced from the drill string 6 so that an annular space is maintained between the holes 66 and the inner surface of the drill string 6 for permitting proper fluid flow through the holes 66. The centralizer 100 is secured between the threadedly connected adapter 40 and overshot 22. The centralizer 100 also helps maintain the overshot 22 centered within the drill string 6 so that it can be readily engaged by suitable retrieval equipment known in the art.

To use the preferred embodiment of the apparatus 8, it is assembled in the manner illustrated in FIGS. 3A–3D. Once assembled, the apparatus 8 can be dropped down the drill string 6, which dropping can be done in a manner as known in the art.

In the drill string 6, the apparatus 8 will fall and/or be pumped downwardly. One position of such descent is shown in FIG. 1.

Ultimately, the apparatus 8 will impact on the drill bit 4. Specifically, the retainer cap 84 will engage the drill bit 4 as shown in FIG. 2. The grooves 88 in the cap 84 prevent sealing between the face 86 of the cap 84 and the drill bit 4.

Upon impact, the dynamic loading created by the weight of the apparatus 8 and its impact velocity is dissipated primarily through the shock absorbing effect of the shock absorber 16. This is primarily a hydraulic shock absorption (the spring 90 will give some cushioning). Chamber 60 of the support body 52 of the shock absorber 16 is filled with fluid against which the enlarged end 74 of the member 54 works as the member 54 relatively retracts into the chamber 60. One position of such retraction is identified by the reference numeral 80 in FIG. 3D. The chamber 60 is either preloaded with a suitable fluid, such as one with a known viscosity, or simply fills with the fluid within the drill string 6 once the apparatus 8 is dropped into the drill string 6. The fluid in the chamber 60 resists or slows the retraction of the member 54, but it yields by flowing out of remaining open ones of the holes 66 in advance of the moving member 54. The shock absorption achieved by the preferred embodiment tends to be linearized by the longitudinally offset, nonoverlapping layout of the holes 66 previously described.

Other shock absorption, both upon impact and during the trip downhole, is obtained by using the resilient ball 94 and the spring 96 supporting the gauge 24 from below and above, respectively. The particular packaging construction of the components of the gauge 24 also helps in the cushioning, as do the centralizers 98, 100.

After the shock has been absorbed by the shock absorber 16, the member 54 can return to the fully extended position under the biasing force of the spring 90.

From the foregoing, it is apparent that the present invention, particularly in its preferred embodiment, has several advantageous characteristics. The electronics and battery packaging is designed to minimize the effects of shock and vibration on the electronic components. The pressure-sealed housing 14 protects the thus packaged gauge 24 from the well bore pressure. The shock absorber 16 absorbs the shock of the final impact by spreading the impact loading over a longer time span. The centralizers 20 maintain a stand-off between the rest of the apparatus 8 and the inner surface of the drill string 6, and they provide drag on the apparatus 8 to reduce the terminal velocity of the apparatus 8. The reduction of terminal velocity reduces the energy the shock absorber 16 has to absorb. The centralizers 20 and the components 18 also provide additional shock absorption or cushioning.

Thus, the present invention is well adapted to carry out the objects and attain the ends and advantages mentioned above as well as those inherent therein. While a preferred embodiment of the invention has been described for the purpose of this disclosure, changes in the construction and arrangement of parts can be made by those skilled in the art, which changes are encompassed within the spirit of this invention as defined by the appended claims.

What is claimed is:

1. A shock absorber for an implement used in a well, comprising:

a support body adapted to connect to the implement, said support body including:

a side wall defining, at least in part, a chamber within said support body; and communication means, defined through said side wall, for permitting fluid communication across and along a length of said side wall between said chamber and the exterior of said support body; and a member retained within said support body to create a shock absorbing effect by movement of said member between a position wherein said member does not block fluid flow through said communication means and a position wherein said member blocks a portion of said communication means so that said member pushes fluid from said chamber through a progressively smaller area of said communication means as said member moves within said support body.

2. A shock absorber as defined in claim 1, wherein said communication means includes two openings, defined through said side wall, longitudinally spaced from each other so that as said member moves within said support body, said member pushes fluid through both said openings until said member blocks a first one of said openings, whereupon continued movement of said member pushes fluid through said other of said openings but not said first one of said openings.

3. A shock absorber as defined in claim 1, further comprising an opening defined through said side wall at a location wherein said opening is adjacent said member at the position wherein said member does not block fluid flow through said communication means.

4. A shock absorber as defined in claim 1, wherein said support body further includes end adapter means, connected to said side wall, for selectably coupling with the implement or a member of another said shock absorber.

5. A shock absorber as defined in claim 1, further comprising a cap connected to said member, said cap including a face which engages a structure in the well when said shock absorber is to function, and said cap having a void defined therein and extending from said face so that said face cannot seal against the structure.

6. A shock absorber as defined in claim 1, wherein:

said support body includes:

an end coupling adapter;

a cylindrical sleeve which includes said side wall, one end of said sleeve receiving said end coupling adapter and the other end of said sleeve receiving said member; and a plurality of rows of openings defining said communication means, each of said rows spaced circumferentially about said sleeve and each opening within a respective row spaced longitudinally from each other opening within the respective row, and openings within a respective row longitudinally offset from openings in another respective row so that only one opening is blocked at a time as said member moves between said positions.

7. An apparatus for carrying an object into a well, comprising:

a housing having a chamber for receiving an object to be carried into a well; and shock absorbing means, connected to said housing, for absorbing shock in response to said apparatus being dropped into the well and said shock absorbing means engaging in the well a stop which prevents further downward movement of said dropped apparatus in the well, said shock absorbing means including: an elongated member; and a sleeve connected at one end to said housing and receiving at another end said elongated member so that said elongated member retracts and extends relative to said sleeve, said sleeve having effective outlet areas which are progressively reduced as said member retracts into said sleeve in response to said member engaging the stop in the well.

8. An apparatus as defined in claim 7, wherein said sleeve includes a plurality of spaced openings having said effective outlet areas, said openings including a plurality of rows of holes defined in said sleeve so that holes in each row are spaced from each other and so that holes in a respective row are longitudinally offset from holes in another respective row.

9. An apparatus as defined in claim 8, wherein said sleeve further has a hole defined adjacent an end of said sleeve where said member is positioned when it is fully extended.

10. An apparatus as defined in claim 7, wherein said shock absorbing means further includes:

another sleeve connected to said member; and another elongated member, extending from said another sleeve.

11. An apparatus as defined in claim 7, wherein said shock absorbing means further includes a grooved end cap connected to said member so that, in response to engaging the stop in the well, said grooved end cap engages but does not seal against the stop.

12. An apparatus as defined in claim 7, further comprising:

a first centralizer, connected between said housing and said sleeve; and a second centralizer, connected to said housing at a location spaced from said first centralizer.

13. An apparatus as defined in claim 7, further comprising:

a resilient ball disposed within said housing for supporting the object from below; and a spring disposed within said housing for supporting the object from above.

14. A downhole tool which can be dropped down a drill string to a drill bit connected at the bottom of the drill string, said tool comprising:

a pressure-sealed housing having a top end and a bottom end;

an electronic temperature gauge carried in said pressure-sealed housing; and a shock absorber connected to said bottom end of said pressure-sealed housing, said shock absorber including:

a piston having a piston head at one end and a free end at the other end;

a piston housing having an upper end connected to said bottom end of said pressure-sealed housing and said piston housing having a lower end receiving said piston head end of said piston, said piston housing having defined therein:

a first set of longitudinally aligned holes; and a second set of longitudinally aligned holes circumferentially spaced from said first set and wherein the holes in said second set are longitudinally offset from the holes in said first set so that each hole lies on a different respective circumferential plane of said piston housing;

a retainer connected to said free end of said piston so that said retainer engages said drill bit after said tool has been dropped down the drill string; and a spring disposed about said piston between said retainer and said lower end of said piston housing, wherein said spring provides a biasing force tending to move said piston to a fully extended position at which said piston head is at said lower end of said piston housing.

15. A tool as defined in claim 14, wherein said piston housing further includes a hole defined therein at said lower end thereof so that said hole is blocked by said piston head when said piston is at said fully extended position.

16. A tool as defined in claim 14, wherein said retainer has openings defined therein to prevent sealing between said retainer and the drill bit.

17. A tool as defined in claim 14, further comprising centralizing means for centralizing said tool within the drill string and for limiting the terminal velocity at which said tool can fall within the drill string.

18. A tool as defined in claim 14, further comprising:

a resilient ball disposed in said pressure-sealed housing between said gauge and said bottom end of said pressure-sealed housing; and a spring disposed in said pressure-sealed housing between said gauge and said top end of said pressure-sealed housing.

19. A tool as defined in claim 14, wherein said gauge includes:

an elongated potted electronics package including at one end a first uncovered mechanical connector; and an elongated potted battery package including at one end a second uncovered mechanical connector manually fastened to said first uncovered mechanical connector.

* * * * *